US009617785B2

(12) United States Patent
Chou

(10) Patent No.: US 9,617,785 B2
(45) Date of Patent: Apr. 11, 2017

(54) EXTENSIBLE CURTAIN RAIL

(71) Applicant: Tser Wen Chou, Taipei (TW)

(72) Inventor: Tser Wen Chou, Taipei (TW)

( * ) Notice: Subject to any disclaimer, the term of this patent is extended or adjusted under 35 U.S.C. 154(b) by 0 days.

(21) Appl. No.: 14/825,128

(22) Filed: Aug. 12, 2015

(65) Prior Publication Data

US 2016/0051074 A1 Feb. 25, 2016

(30) Foreign Application Priority Data

Aug. 22, 2014 (TW) ..... 103215097 U

(51) Int. Cl.

| | |
|---|---|
| ***A47F 5/00*** | (2006.01) |
| ***E06B 9/24*** | (2006.01) |
| ***E06B 9/42*** | (2006.01) |
| ***E06B 9/50*** | (2006.01) |

(52) U.S. Cl.

CPC ..... *E06B 9/24* (2013.01); *E06B 9/42* (2013.01); *E06B 9/50* (2013.01); *E06B 2009/2405* (2013.01); *E06B 2009/2458* (2013.01)

(58) Field of Classification Search

USPC ..... 248/298.1

See application file for complete search history.

(56) References Cited

U.S. PATENT DOCUMENTS 4,531,562 A * 7/1985 Swanson ..... E06B 9/24 160/26
4,649,980 A * 3/1987 Kunz ..... E06B 9/24 160/26
5,515,901 A * 5/1996 Hall ..... E05D 15/264 160/206
6,532,625 B1 * 3/2003 Stone ..... A47H 1/06 16/87.4 R
7,134,469 B2 * 11/2006 Drew ..... E06B 9/56 160/38
7,441,582 B2 * 10/2008 Lukos ..... E04F 10/0662 160/23.1
7,900,680 B2 * 3/2011 Garmyn ..... E06B 9/42 160/23.1
8,967,227 B2 * 3/2015 Chou ..... A47H 1/14 160/23.1
2004/0182522 A1 * 9/2004 Strand ..... E06B 9/262 160/84.05
2005/0205216 A1 * 9/2005 Vrielink ..... E06B 9/323 160/23.1
2008/0041534 A1 * 2/2008 Jensen ..... E06B 9/323 160/174 R
2008/0289775 A1 * 11/2008 Lukos ..... E04F 10/0662 160/242
2011/0067821 A1 * 3/2011 Byeon ..... D03D 1/08 160/123

(Continued)

*Primary Examiner* — Monica Millner
(74) *Attorney, Agent, or Firm* — Guice Patents PLLC

(57) ABSTRACT

An extensible curtain rail includes a rail main body, more than one connection seat and a decorative panel. The decorative panel and the rail main body are assembled and connected with each other by means of the connection seat. The connection seat can be inward contracted or outward extended to adjust the gap between the decorative panel and the rail main body in accordance with different sizes of curtain assemblies to facilitate installation thereof. The decorative panel is detachable from the rail main body to provide larger installation space and more quickly install the curtain assembly.

6 Claims, 15 Drawing Sheets

(56) References Cited

U.S. PATENT DOCUMENTS

| | | | | |
|---|---|---|---|---|
| 2011/0114809 | A1* | 5/2011 | Ng | E06B 9/323<br>248/309.1 |
| 2011/0132556 | A1* | 6/2011 | Kao | E06B 9/42<br>160/368.1 |
| 2012/0000617 | A1* | 1/2012 | Chu | E06B 9/24<br>160/349.1 |
| 2012/0291965 | A1* | 11/2012 | Marocco | E06B 9/40<br>160/120 |
| 2014/0048218 | A1* | 2/2014 | Ng | E06B 9/42<br>160/293.1 |
| 2014/0069592 | A1* | 3/2014 | Hsu | E06B 9/38<br>160/84.05 |
| 2014/0251558 | A1* | 9/2014 | Chou | E06B 9/42<br>160/323.1 |

* cited by examiner

EXTENSIBLE CURTAIN RAIL

BACKGROUND OF THE INVENTION

1. Field of the Invention

The present invention relates generally to an extensible curtain rail, and more particularly to a rail structure, which enables a user to more conveniently and quickly install the curtain assembly.

2. Description of the Related Art

When installing a curtain assembly under the upper wall face of a window, generally the curtain assembly (including the curtain sheet winder, the reel and the curtain sheet) is previously mounted on the installation rail. Then, several fixing latch plates are latched with the installation rail and locked under the upper wall face of the window. Under such circumstance, the curtain can provide sunlight shading effect. Moreover, in order to conceal the curtain assembly to enhance the beauty of the appearance, a decorative panel integrally extends from the front end of the conventional installation rail to decorate the curtain assembly.

However, the decorative panel and the installation rail are an integrated structure. With respect to the operation space in installation, the installation can be only performed from the lower space under the installation rail and the lateral space beside the installation space. The narrow space makes it uneasy to install the curtain assembly. As a result, the installation speed is slowed down.

SUMMARY OF THE INVENTION

It is therefore a primary object of the present invention to provide an extensible curtain rail includes a rail main body, more than one connection seat and a decorative panel. The rail main body has a connection end. The decorative panel has an extension end. The extension end of the decorative panel can be extensibly assembled and connected with the connection end of the rail main body by means of the connection seat. The connection seat can be inward contracted or outward extended to adjust the connection width between the decorative panel and the rail main body in accordance with different sizes of curtain assemblies to facilitate the installation thereof. The decorative panel is detachable from the rail main body to provide larger installation space for the rail main body and more easily and quickly install the curtain assembly.

To achieve the above and other objects, the extensible curtain rail of the present invention includes a rail main body, more than one connection seat and a decorative panel. The rail main body has an upper horizontal board, a lower horizontal board, a front vertical board and a rear vertical board. Two latch protruding rims protrude from two sides of the upper horizontal board for securely connecting and latching with fixing latch plates. A connection end is disposed at the front end of the lower horizontal board. A receiving cavity is disposed on the rear vertical board. One end of a zebra curtain sheet is fixedly disposed in the receiving cavity. An upper end face of the connection end extending from the front end of the lower horizontal board is formed with teeth. The connection seat is connected with the connection end of the rail main body. The connection seat includes a horizontal board and a vertical board. The horizontal board is formed with an upper stop board and a lower stop board. A lower face of the upper stop board is formed with teeth for engaging with the teeth of the connection end of the rail main body. The vertical board serves to engage and connect with the decorative panel. The decorative panel includes a decorative board and an extension end. The decorative board downward extends to form a receiving channel for receiving a decoration board. The extension end horizontally extends from an upper section of the decorative board. An engagement channel is formed in the inner corner between the decorative board and the extension end for inserting with the vertical board of the connection seat. The connection end of the rail main body is extensibly connected with the extension end of the decorative panel by means of the connection seat. The connection seat can be inward contracted or outward extended to adjust the connection distance/space between the decorative panel and the rail main body in accordance with different sizes of curtain assemblies, whereby the curtain assembly can be more conveniently and quickly installed.

The present invention can be best understood through the following description and accompanying drawings, wherein:

DETAILED DESCRIPTION OF THE PREFERRED EMBODIMENTS

Figure 1:
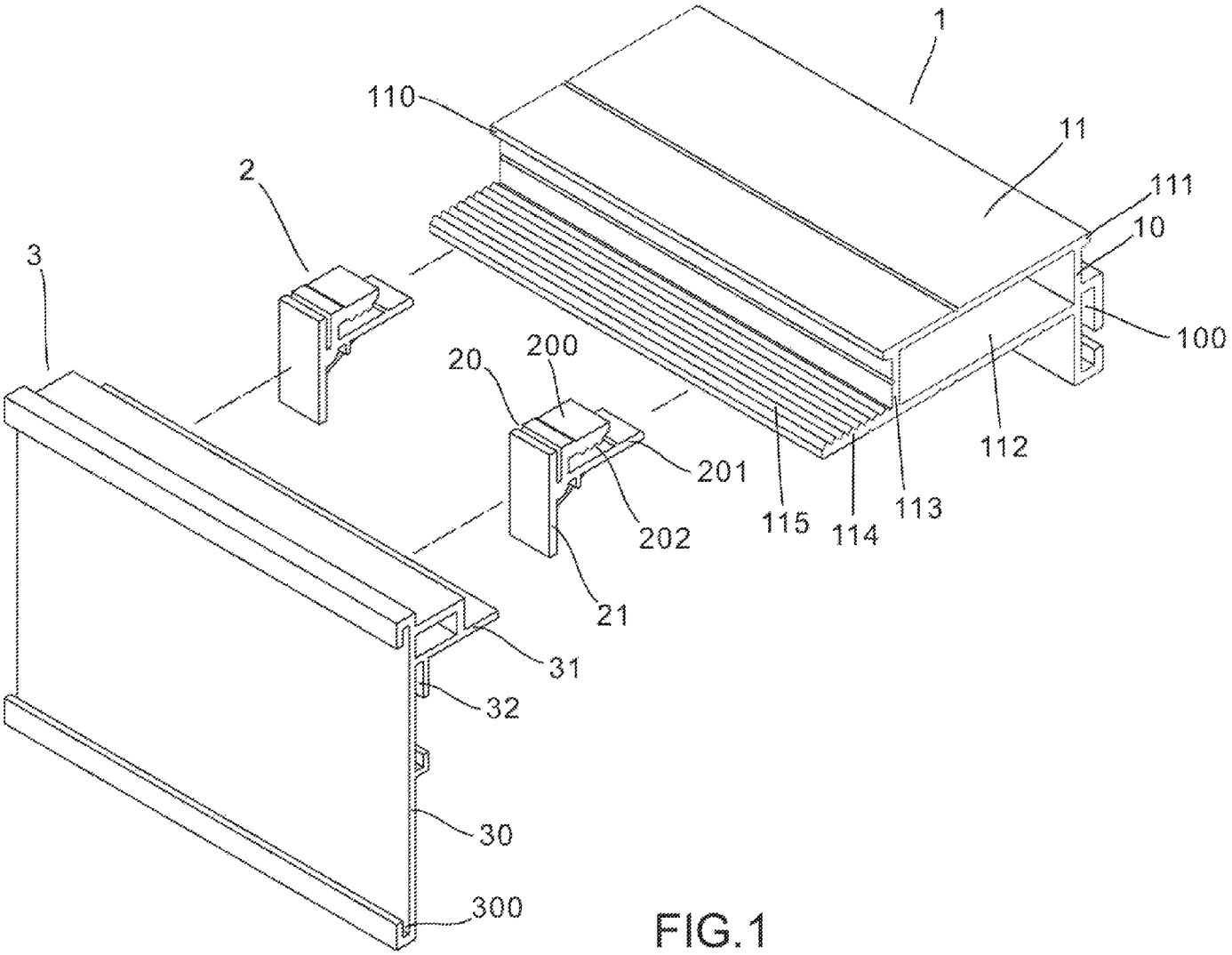
FIG. 1 is a perspective exploded view of the present invention.
Figure 2:
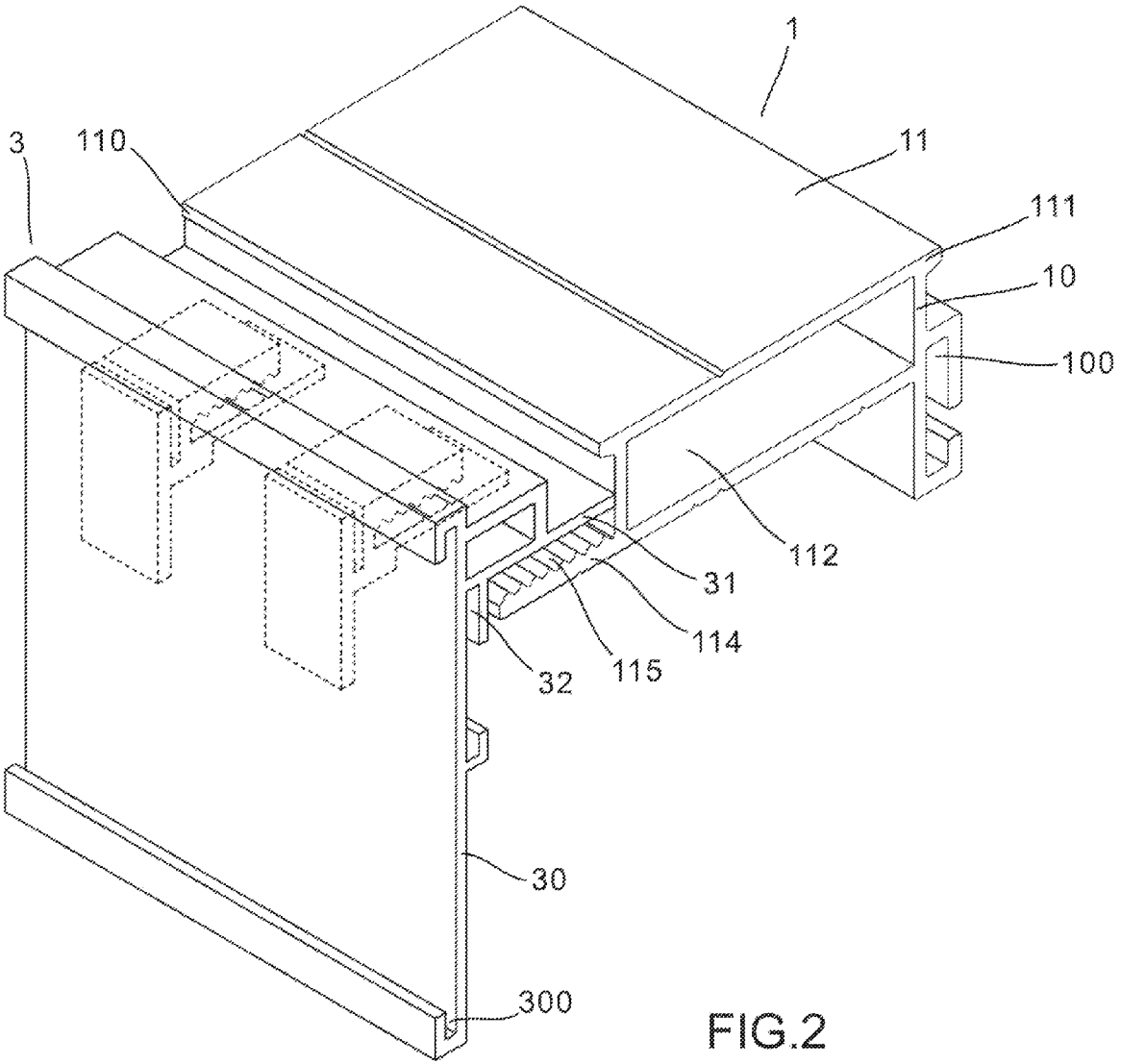
FIG. 2 is a perspective assembled view of the present invention.
Figure 3:
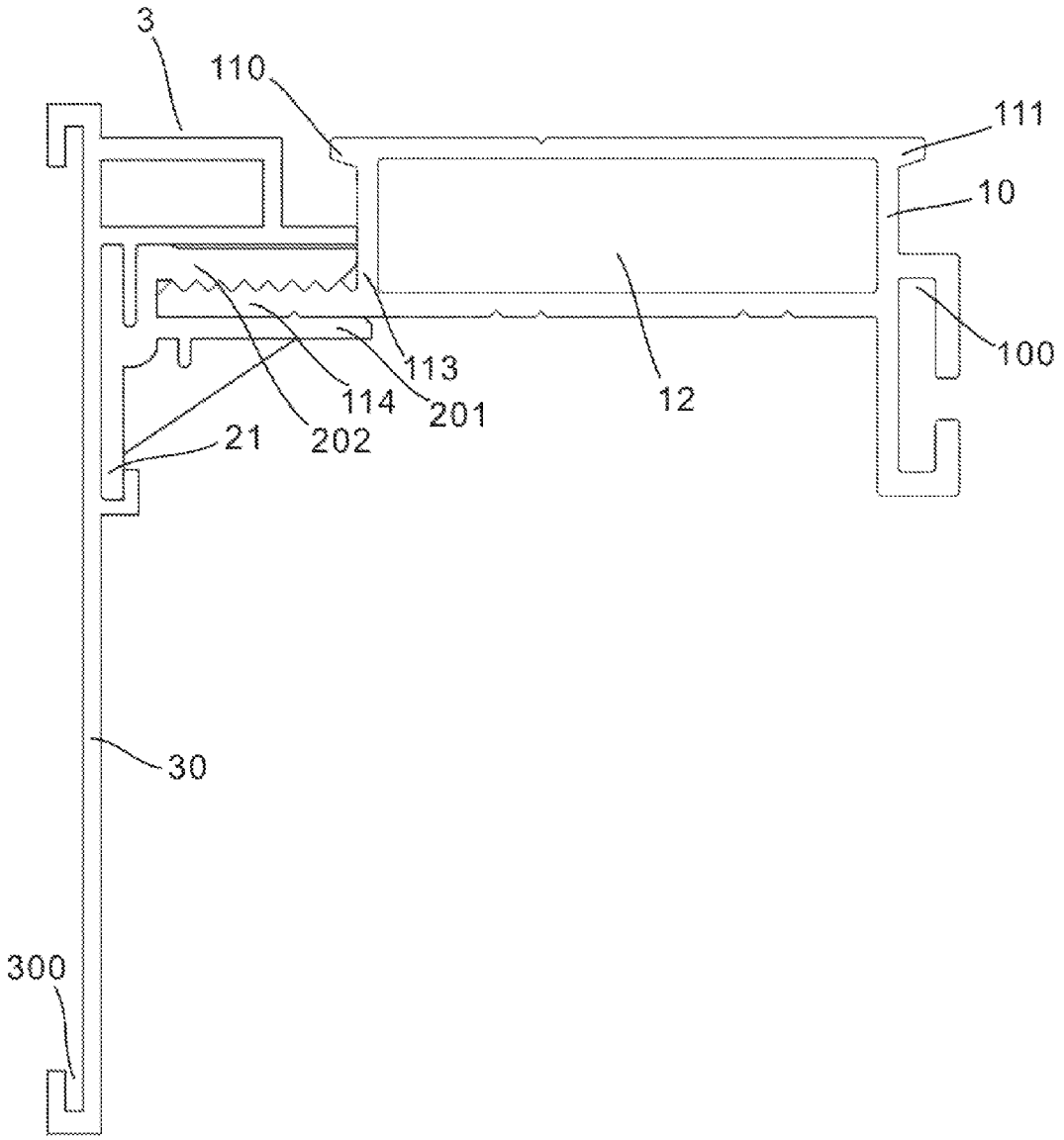
FIG. 3 is a plane assembled view of the present invention.

Please refer to FIGS. 1 and 2. The present invention provides an extensible curtain rail including a rail main body 1 and more than one connection seat 2 and a decorative panel 3. The rail main body 1 has a front vertical board 113, a rear vertical board 10, an upper horizontal board 11 and a lower horizontal board 112. The rear vertical board 10 extends to form a receiving cavity 100 for receiving a zebra curtain sheet. Two latch protruding rims 110, 111 integrally protrude from the upper horizontal board 11 for securely connecting and latching with fixing latch plates. A connection end 114 extends and protrudes from a front end of the lower horizontal board 11. An upper end face of the connection end 114 is formed with teeth 115 for cooperatively connecting with the connection seat 2. The connection seat 2 is connected with the connection end 114 of the rail main body 1. The connection seat 2 includes a horizontal board 20 and a vertical board 21. The horizontal board 20 is formed with an upper stop board 200 and a lower stop board 201. A lower face of the upper stop board 200 is formed with teeth 202 for engaging with the teeth 115 of the connection end 114 of the rail main body 1. The vertical board 21 serves to engage and assemble with the decorative panel 3. The decorative panel 3 includes a decorative board 30 and an extension end 31. The decorative board 30 downward vertically extends to form a receiving channel 300 for receiving a decoration board. The extension end 31 perpendicularly protrudes from an upper section of the decorative board 30. An engagement channel 32 is formed in the inner corner between the decorative board 30 and the extension end 31 for inserting with the vertical board 21 of the connection seat 2. The connection seat 2 is inserted and engaged with the rail main body 1 and the decorative panel 2 to assemble the rail main body 1 and the decorative panel 2 into an extensible rail structure, which is adjustable in width (as shown in FIGS. 2 and 3).

Figure 4:
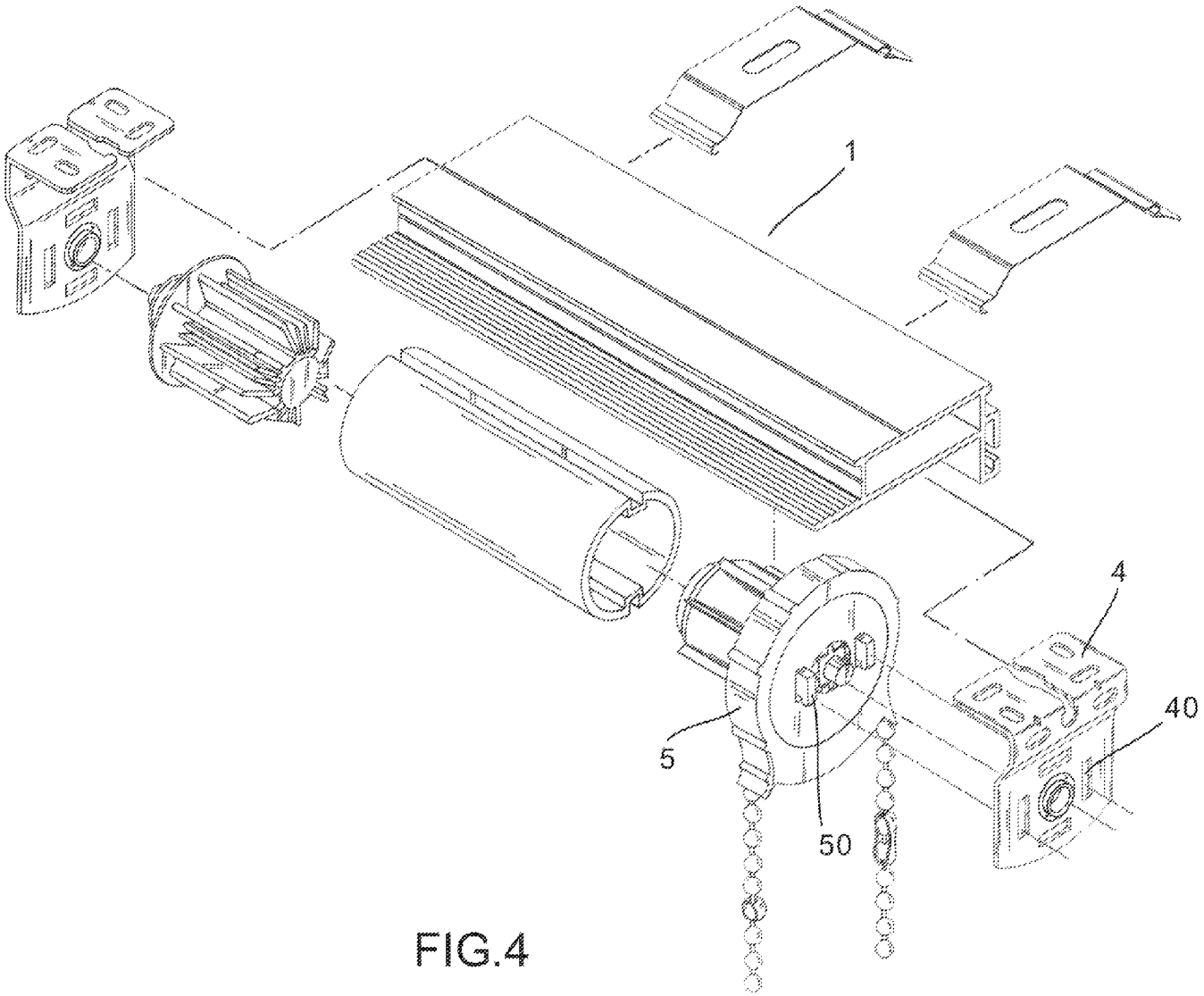
FIG. 4 is a perspective exploded view of the present invention, showing the installation thereof.
Figure 5:
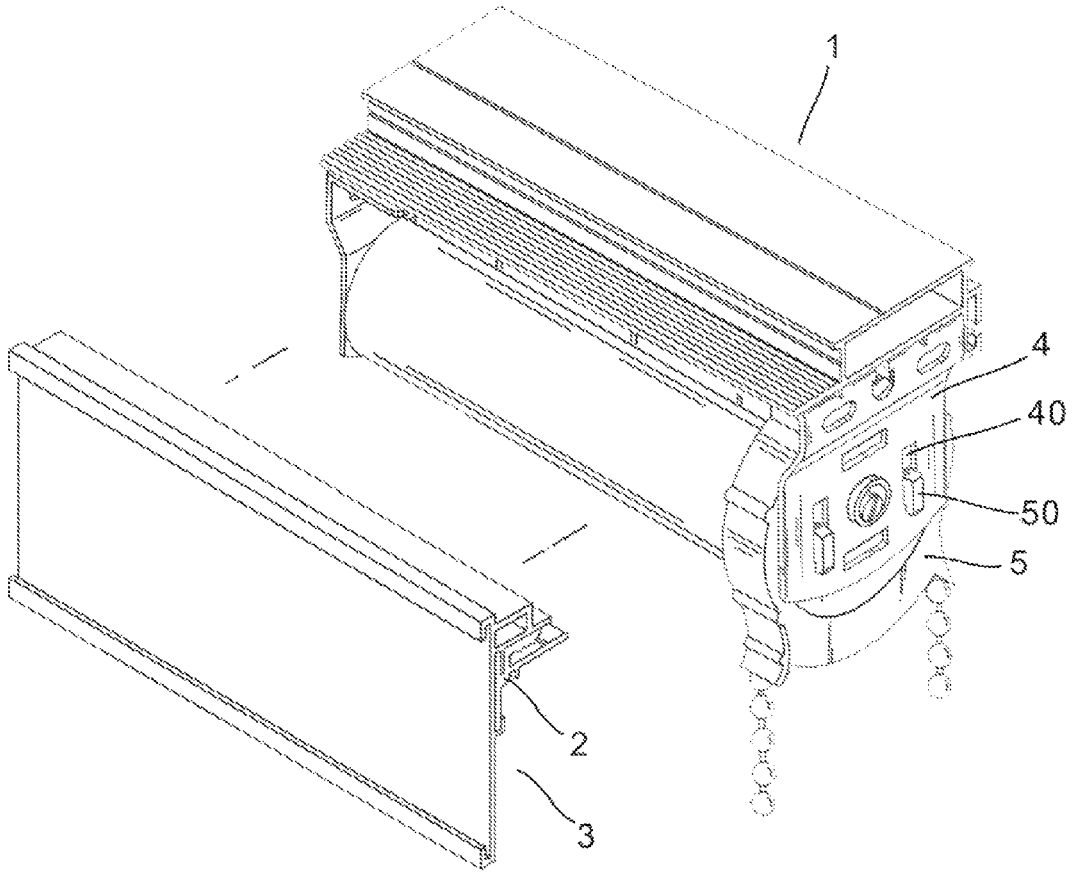
FIG. 5 is a perspective exploded view of the present invention, showing the installation thereof.
Figure 6:
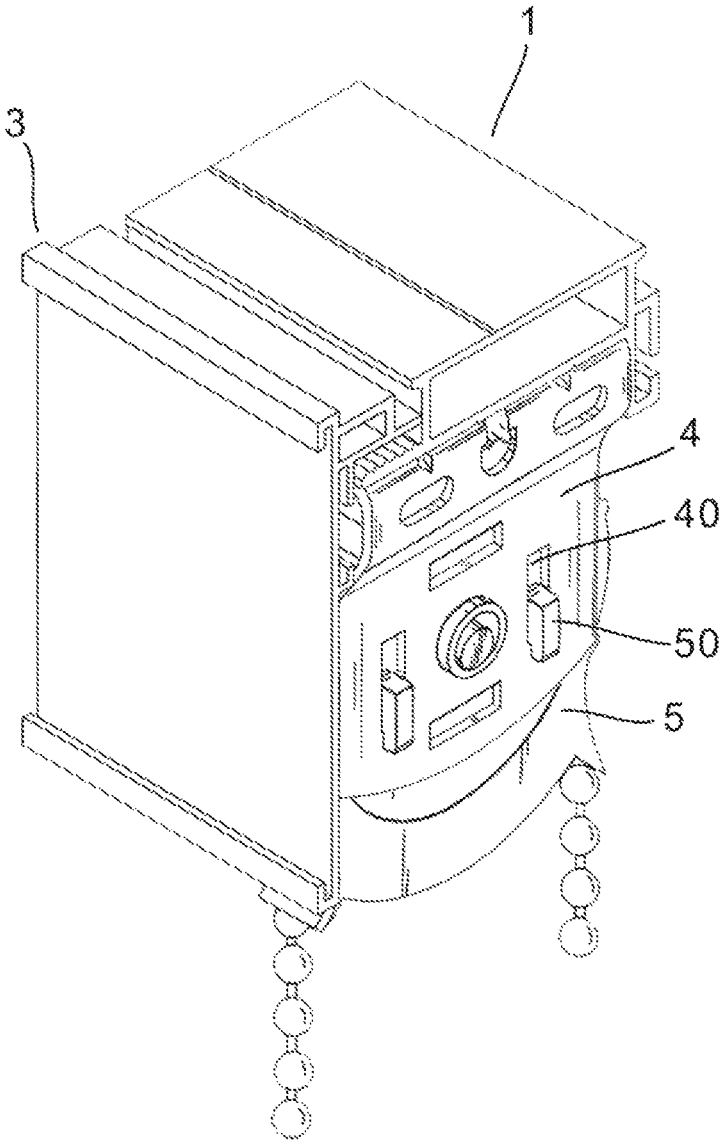
FIG. 6 is a perspective assembled view of the present invention, showing that the assembly of the present invention is completed.
Figure 7:
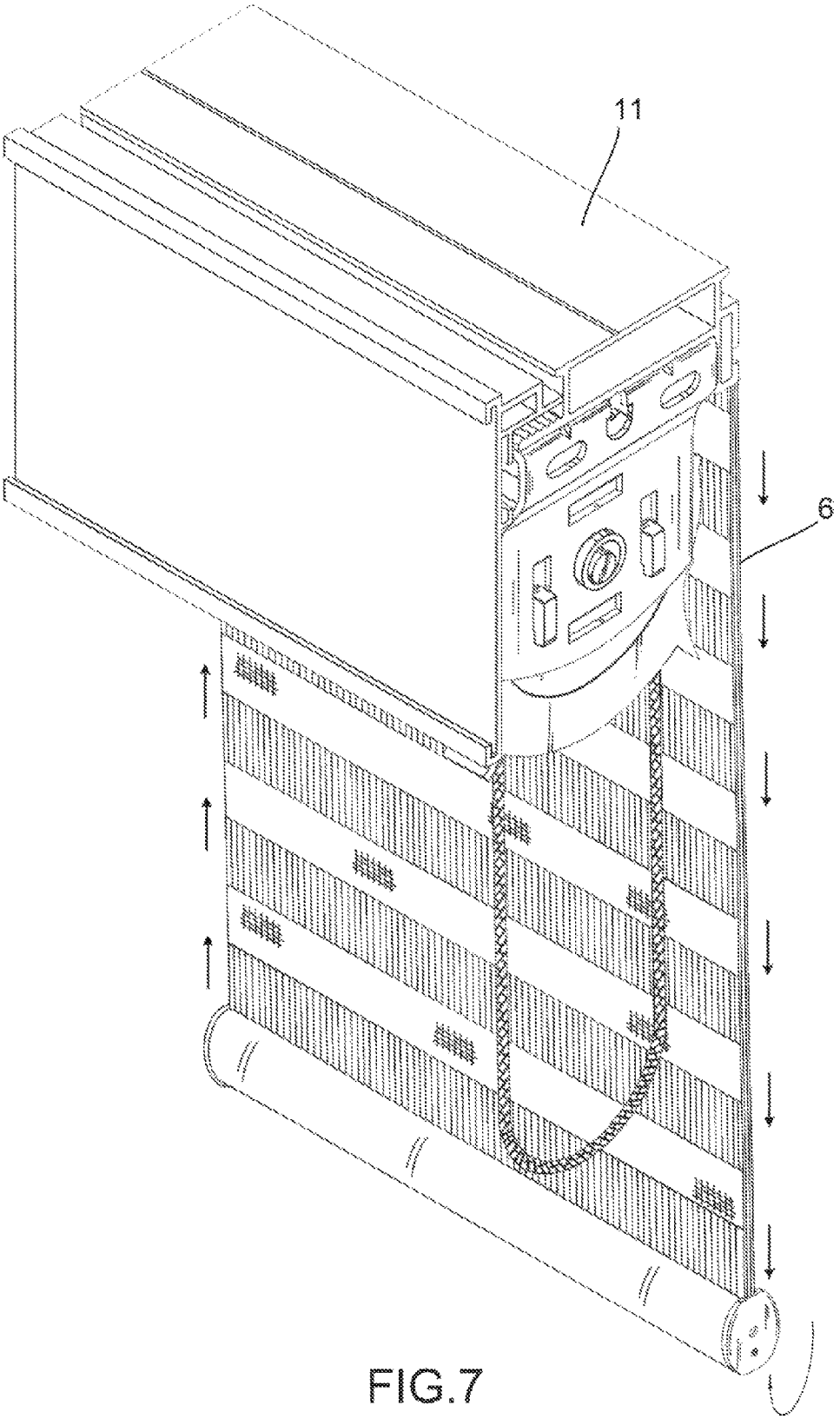
FIG. 7 is a perspective assembled view of the present invention, showing that the installation of the present invention is completed.
Figure 8:
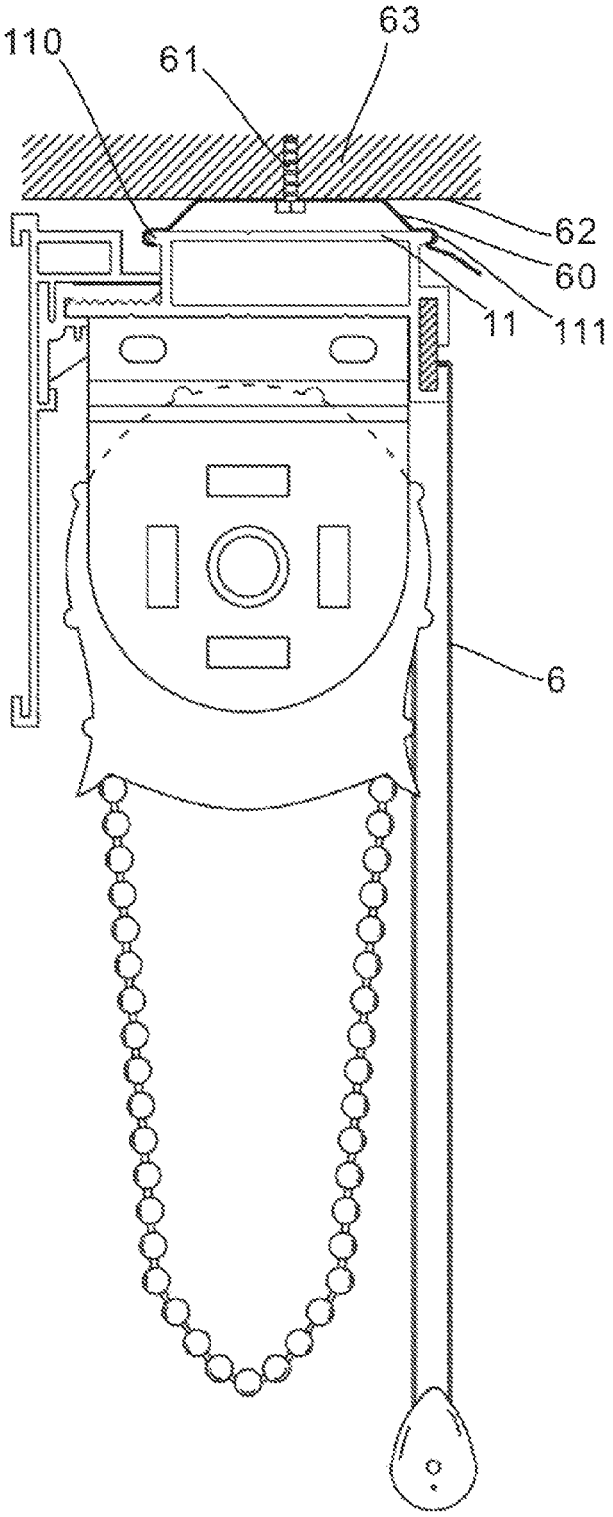
FIG. 8 is a sectional assembled view of the present invention, showing that the installation of the present invention is completed.

Referring to FIG. 4, when installed, the rail structure of the present invention is locked with a curtain fixing bracket 4. Then, the latch blocks 50 of the winder 5 are latched and assembled with the perforations 40 of the curtain fixing bracket 4. The assembly of the winder 5 and the curtain fixing bracket 4 is securely disposed in the space under the rail. After the curtain assembly is mounted under the rail, the decorative panel 3 is directly latched with one side of the rail main body 1 via the connection seat 2 (as shown in FIG. 5) to complete the assembly of the curtain assembly (as shown in FIG. 6) for mounting the curtain sheet 6 on the curtain assembly. Finally, the fixing latch plates 60 are latched with the latch protruding rims 110, 111 of the upper horizontal board 11 and fixing members 61 are used to lock the fixing latch plates 60 under the upper wall face 63 of a window 62. Under such circumstance, the curtain assembly can be operated to provide sunlight shading effect (as shown in FIGS. 7 and 8).

Figure 9:
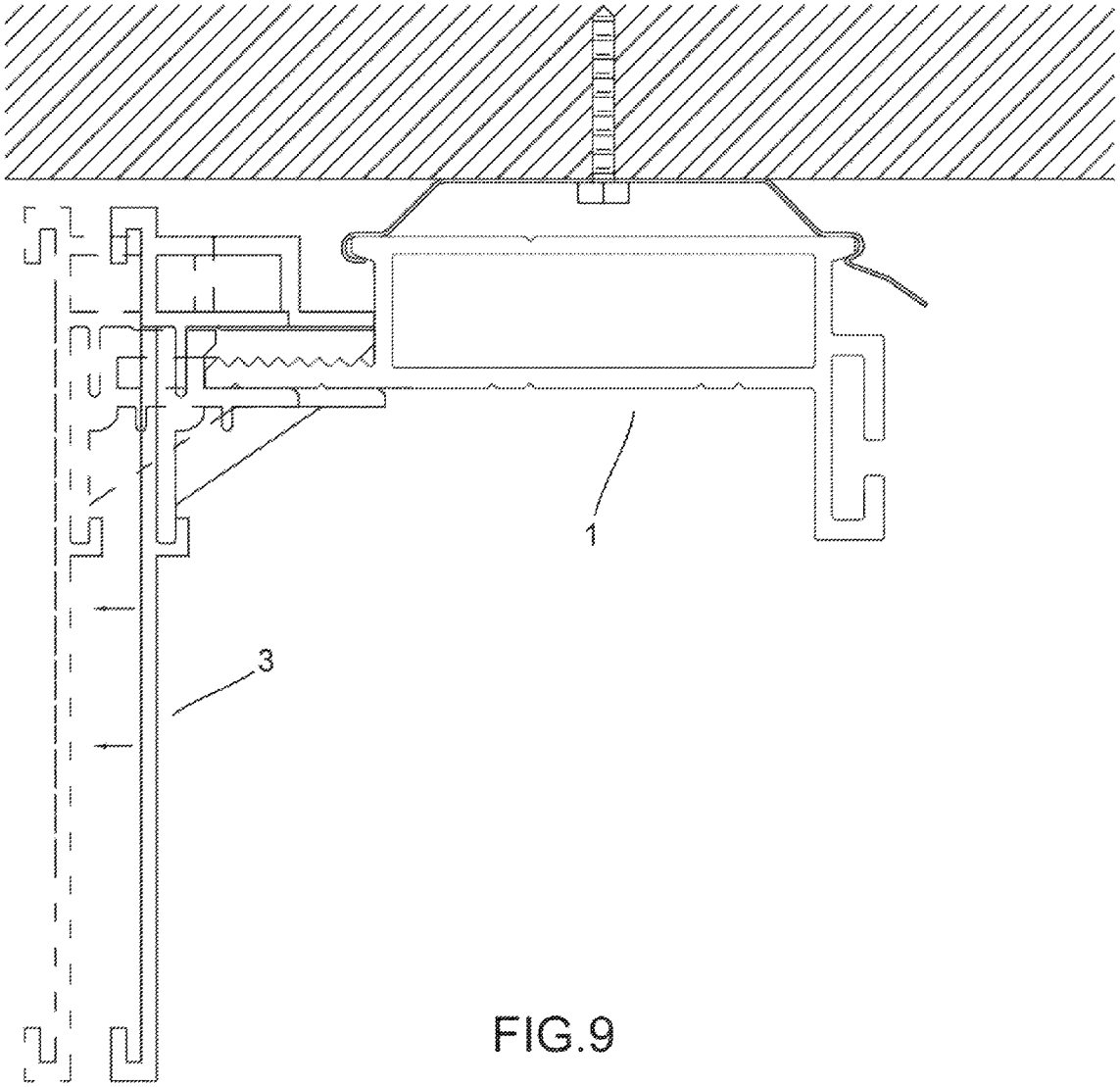
FIG. 9 is a sectional view of the present invention, showing that the decorative panel is pulled and extended from the rail main body of the present invention.

Please now refer to FIG. 9. When it is desired to install a larger curtain assembly, the decorative panel 3 can be outward pulled and extended from the rail main body 1, whereby the enclosure space of the rail main body 1 and the decorative panel 3 is enlarged for mounting a larger size of curtain assembly.

Figure 10:
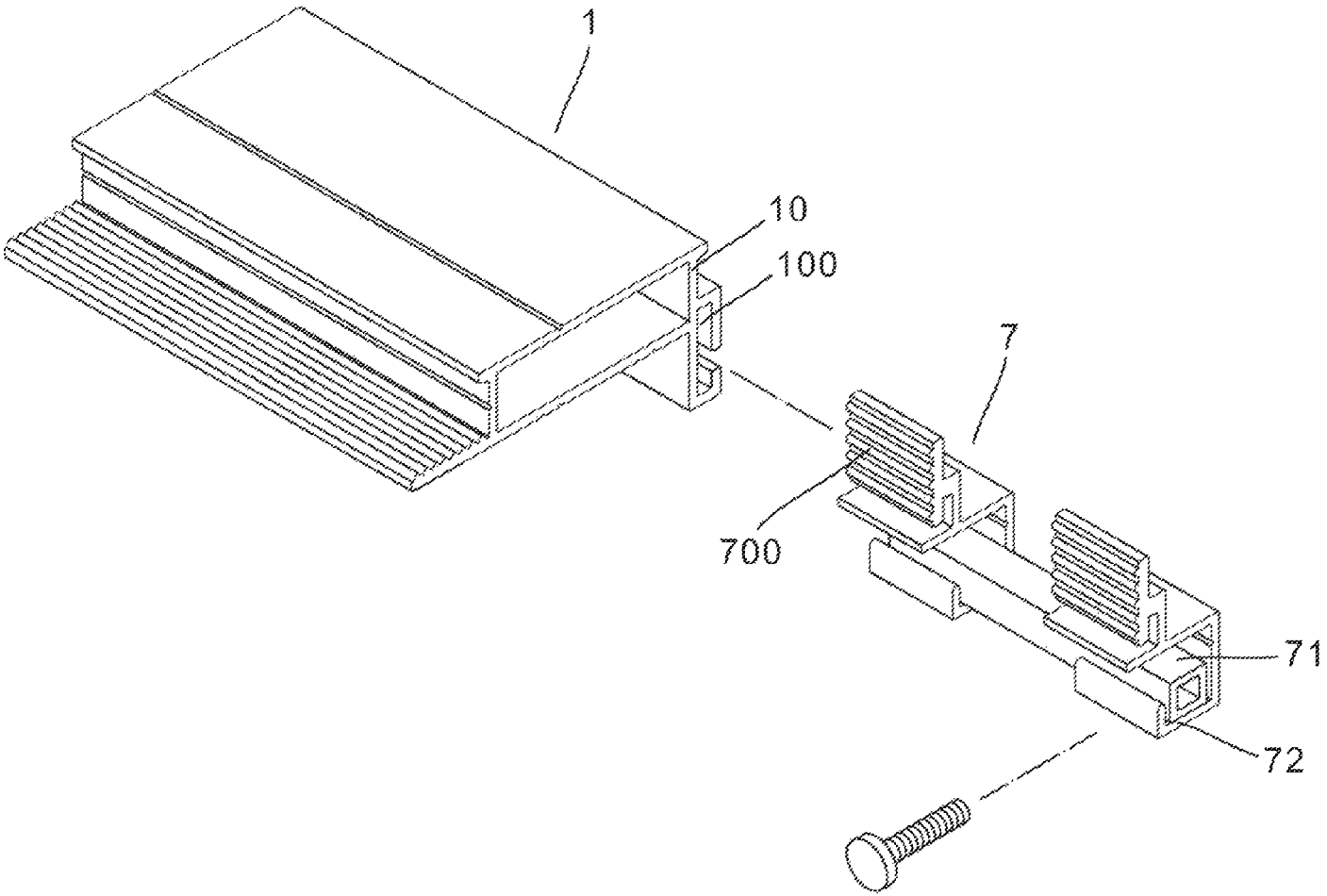
FIG. 10 is a perspective exploded view of another embodiment of the present invention.
Figure 11:
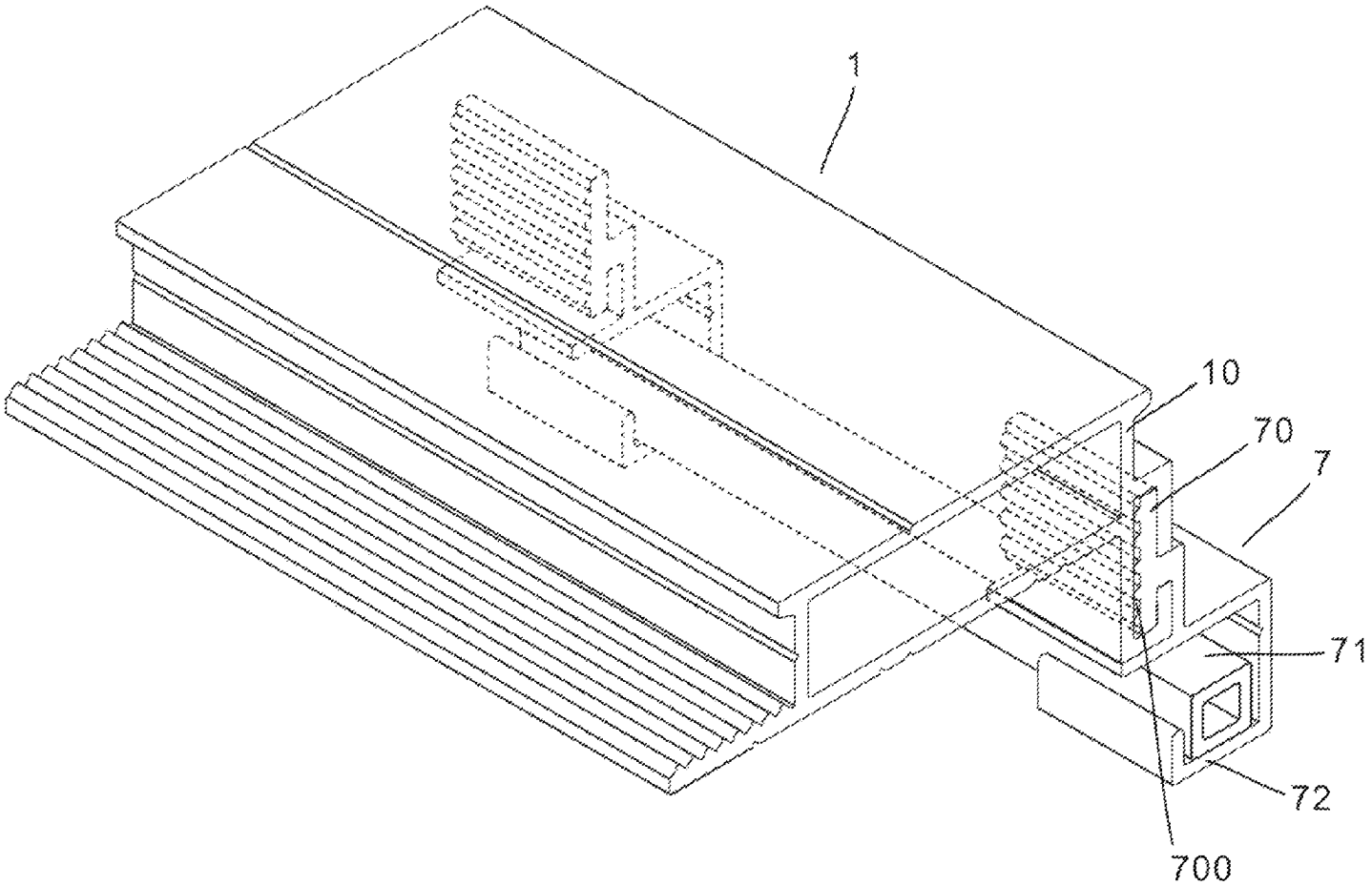
FIG. 11 is a perspective assembled view of the other embodiment of the present invention.

Please refer to FIG. 10. In order to micro-adjust the installation of the zebra curtain, more than one hanger 7 is inserted in the receiving cavity 100 of the rear vertical board 10 of the rail main body 1. An insertion board 70 is disposed at upper end of the hanger 7 for inserting with the receiving cavity 100. The insertion board 70 is formed with engagement teeth 700 for securely engaging in the receiving cavity 100. A lower end of the hanger 7 is formed with a hanging board 72 for receiving a rotary rod 71 therein. A plug bar 73 is cooperatively plugged in the hanging board 72 to prevent the rotary rod 71 from rolling within the hanging board 72 and achieve a locating effect (as shown in FIG. 11).

Figure 12:
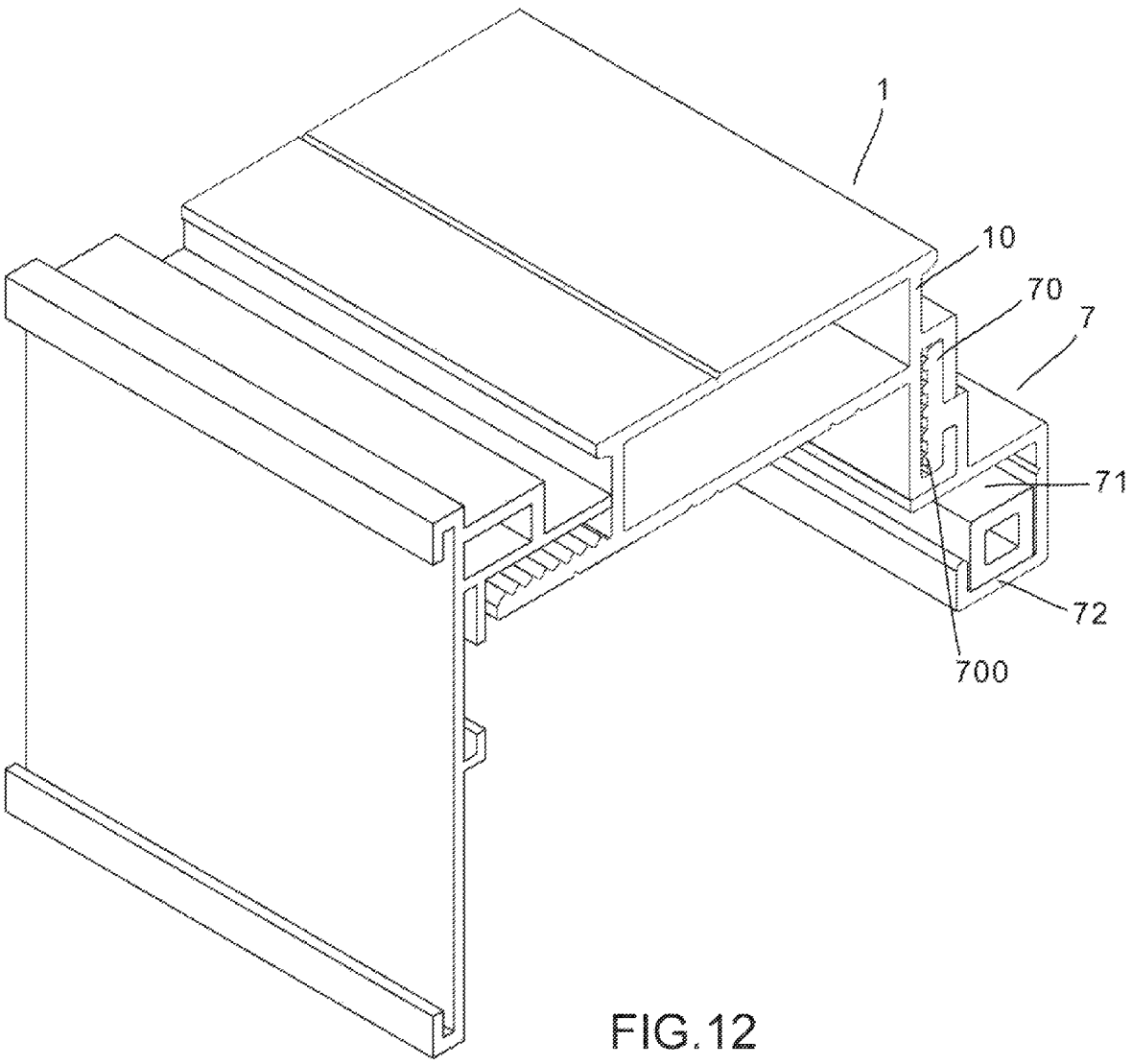
FIG. 12 is a perspective assembled view of the other embodiment of the present invention, showing that the assembly of the present invention is completed.
Figure 13:
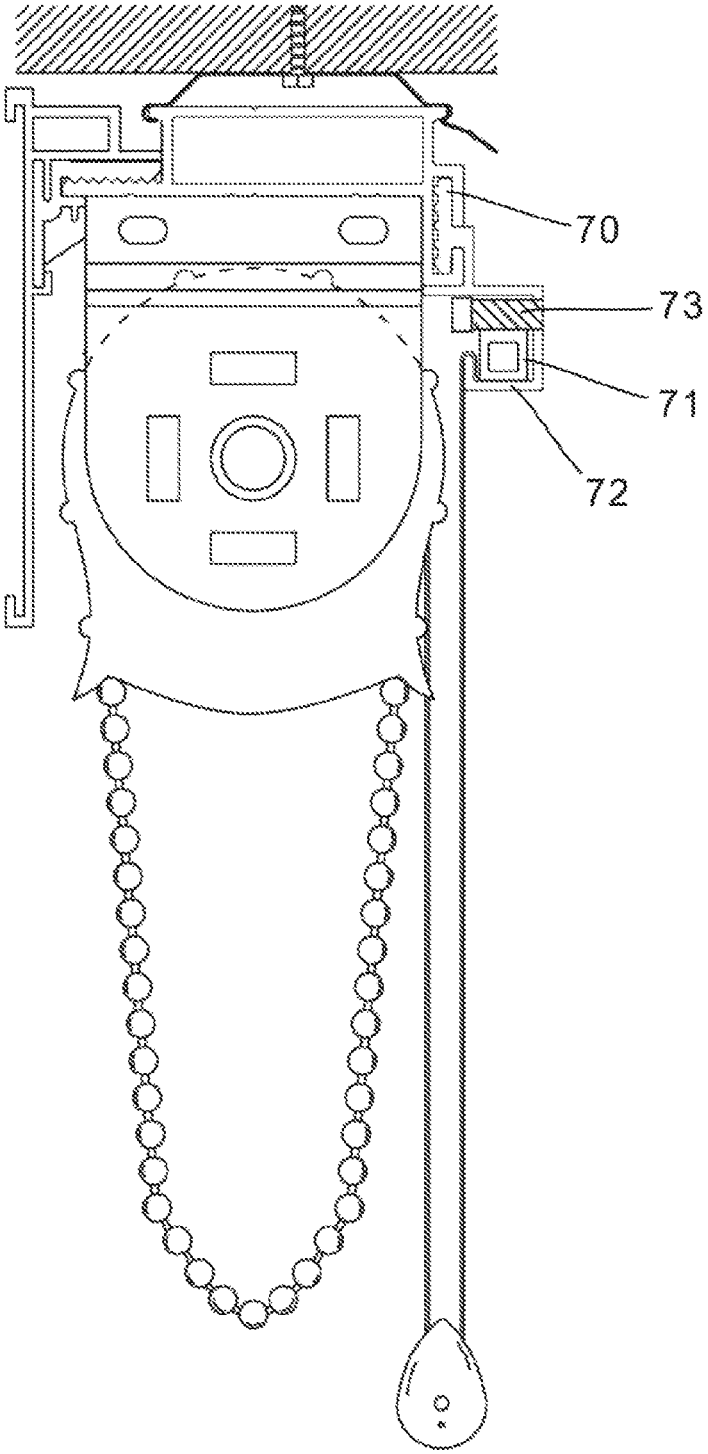
FIG. 13 is a sectional assembled view of the other embodiment of the present invention, showing that the assembly of the present invention is completed.
Figure 14:
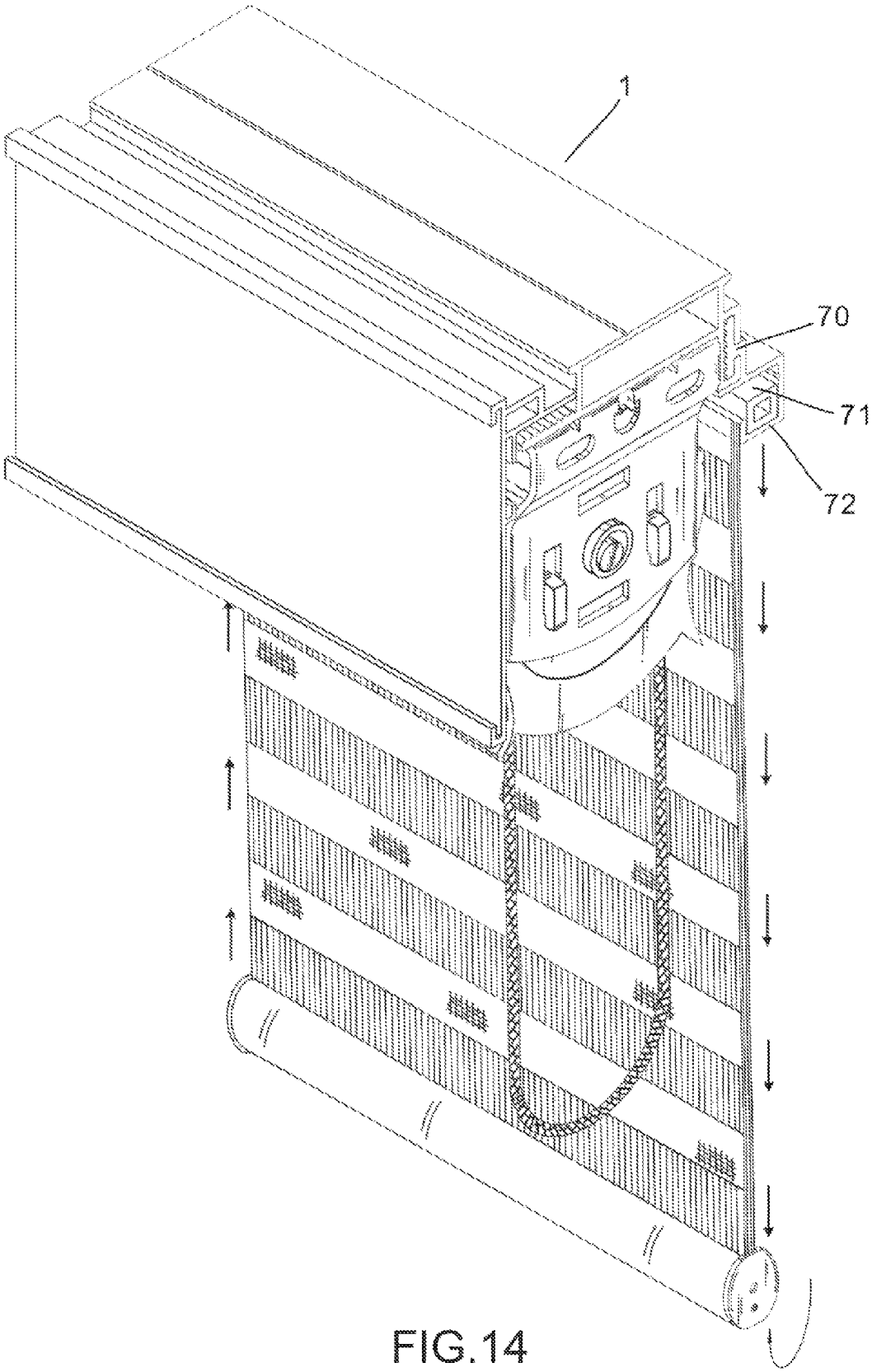
FIG. 14 is a perspective assembled view of the other embodiment of the present invention, showing the installation of the present invention.

Please refer to FIGS. 12 to 14. When installing the zebra curtain, the hanger 7 is first connected with the rail main body 1. Then, the zebra curtain sheet 74 is assembled on the rotary rod 71. Thereafter, the curtain components are mounted under the rail main body 1 to complete the installation of the zebra curtain. When it is desired to micro-adjust the gap between two faces of the zebra curtain sheets 74, a user only needs to operate the rotary rod 71 to micro-adjust the curtain sheet up and down (as shown in FIG. 14).

Figure 15:
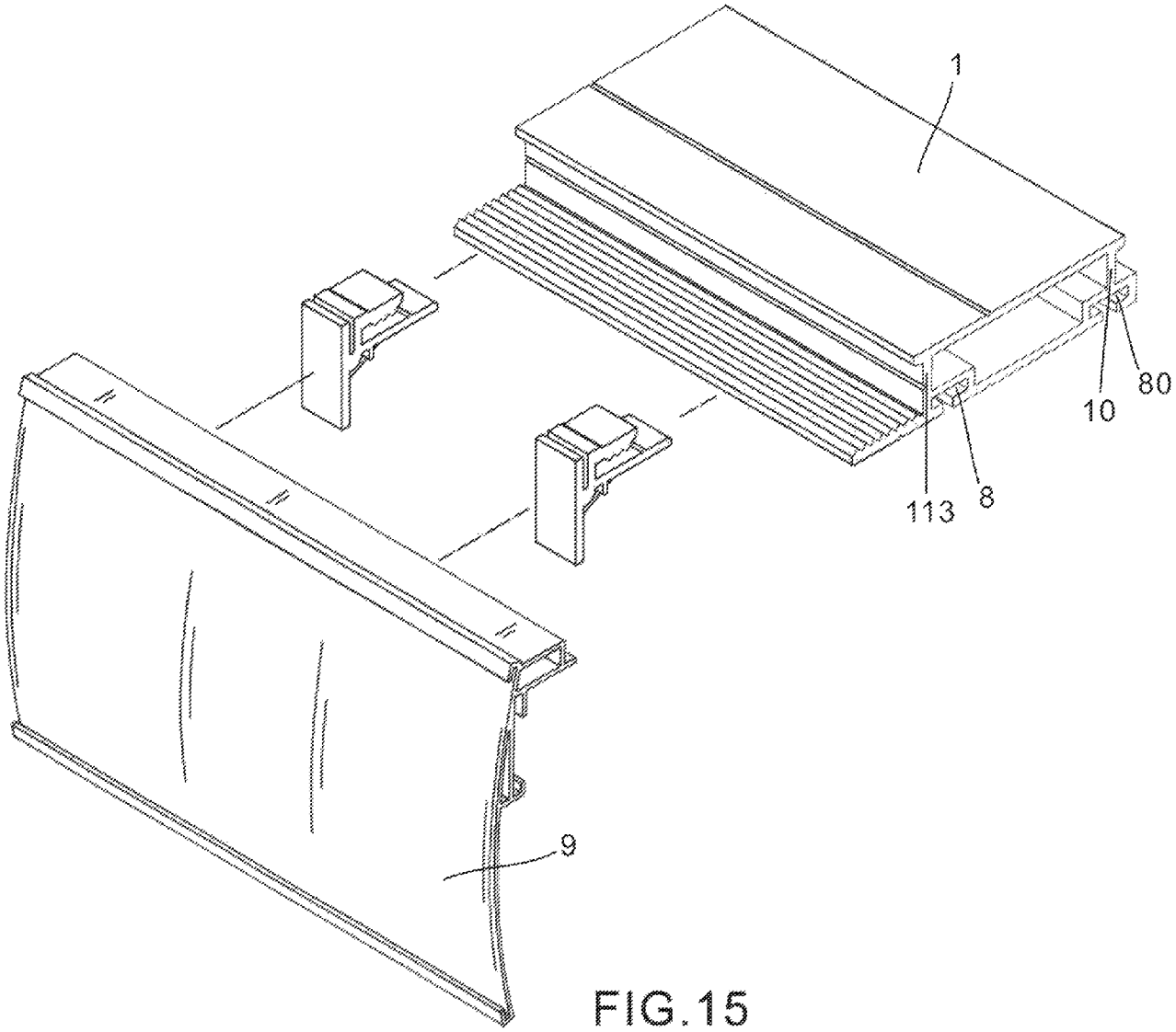
FIG. 15 is a perspective exploded view of still another embodiment of the present invention.

Please further refer to FIG. 15. In another embodiment of the present invention, the structure of the receiving cavity of the rail main body 1 is modified. In this embodiment, the lower ends of the two vertical boards 10, 113 of the rail main body 1 are respectively formed with two horizontal receiving cavities 8, 80. In this case, one of the receiving cavities 8, 80 of the rail main body 1 can be selected for quickly installing the zebra curtain. Moreover, with respect to the structure of the decorative panel (as shown in FIG. 15), the decorative board 9 of the decorative panel is formed with an arched face to more beautify the appearance of the zebra curtain.

The above embodiments are only used to illustrate the present invention, not intended to limit the scope thereof. Many modifications of the above embodiments can be made without departing from the spirit of the present invention.

What is claimed is:

1. An extensible curtain rail for a zebra curtain seat, the extensible curtain rail comprising:

a rail main body, which is a hollow structure, the rail main body having an upper horizontal board, a lower horizontal board, a front vertical board, a rear vertical board, a connection end forward integrally extending from the lower horizontal board and a receiving cavity disposed on the rear vertical board for engaging with a zebra curtain sheet, an upper end face of the connection end being formed with teeth for assembling and connecting with more than one connection seat;

the more than one connection seat for connecting the rail main body with a decorative panel, each connection seat of the more than one connection seat including a horizontal board and a vertical board, the horizontal board having an upper stop board and a lower stop board, the upper and lower stop boards defining therebetween a space for the connection end of the rail main body to directly insert and connect with the rail main body, the vertical board serving to insert with the decorative panel; and the decorative panel including a decorative board and an extension end, a receiving channel downward extending from the decorative board for receiving a decoration board, the extension end perpendicularly protruding from an upper section of the decorative board, an engagement channel being formed between the decorative board and the extension end for assembling and connecting with the vertical board of the connection seat.

2. The extensible curtain rail as claimed in claim 1, wherein a lower face of the upper stop board of the horizontal board of the connection seat is formed with teeth for engaging with the teeth of the connection end of the rail main body.

3. The extensible curtain rail as claimed in claim 1, wherein lower ends of the front and rear vertical boards of the rail main body are respectively formed with more than one horizontal receiving cavity.

4. The extensible curtain rail as claimed in claim 1, wherein the connection end forward extending from the lower horizontal board of the rail main body is an independent body separable from the rail main body.

5. The extensible curtain rail as claimed in claim 1, wherein a hanger is further received in the receiving cavity of the rear vertical board of the rail main body.

6. The extensible curtain rail as claimed in claim 5, wherein the hanger has an insertion board formed with engagement teeth, a hanging board integrally extending from a lower end of the insertion board for receiving and assembling with a rotary rod of the zebra curtain sheet.

* * * * *